United States Patent [19]

Dettinger et al.

[11] Patent Number: 4,981,078

[45] Date of Patent: Jan. 1, 1991

[54] DEVICE FOR CLEANING THE WORK SURFACES OF A WORK MACHINE, MORE PARTICULARLY IN A PRINTING PRESS

[75] Inventors: Dietrich Dettinger, Heusenstamm; Roland Holl, Weiterstadt, both of Fed. Rep. of Germany

[73] Assignee: MAN Roland Druckmaschinen AG, Fed. Rep. of Germany

[21] Appl. No.: 328,001

[22] Filed: Mar. 23, 1989

[30] Foreign Application Priority Data

Mar. 23, 1988 [DE] Fed. Rep. of Germany ..... 3809739

[51] Int. Cl.[5] ..... B41F 35/06; B41L 41/06

[52] U.S. Cl. ..... 101/424; 101/425

[58] Field of Search ..... 101/425, 423, 424, 417, 101/418

[56] References Cited

U.S. PATENT DOCUMENTS

| | | | |
|---|---|---|---|
| 2,492,181 | 12/1949 | Richter | 101/425 |
| 2,525,982 | 10/1950 | Wescott | 101/425 |
| 2,895,414 | 7/1959 | Büttner | 101/425 |
| 3,463,082 | 8/1969 | Käufer | 101/425 |
| 3,615,397 | 10/1971 | Dimond et al. | 101/425 |
| 4,016,812 | 4/1977 | Lauk et al. | 101/425 |
| 4,058,059 | 11/1977 | Moestue | 101/425 |
| 4,651,644 | 3/1987 | Kaempfe et al. | 101/425 |
| 4,765,242 | 8/1988 | Oya et al. | 101/425 |

FOREIGN PATENT DOCUMENTS

| | | | |
|---|---|---|---|
| PS1179233 | 10/1964 | Fed. Rep. of Germany . | |
| 3005469C2 | 7/1987 | Fed. Rep. of Germany . | |
| 2759 | 8/1982 | Japan | 101/425 |
| 7603442 | 1/1977 | Netherlands | 101/425 |
| 647718A5 | 2/1985 | Switzerland . | |

*Primary Examiner*—Edgar S. Burr
*Assistant Examiner*—Joseph R. Keating
*Attorney, Agent, or Firm*—Leydig, Voit & Mayer

[57] ABSTRACT

A device for cleaning the working surfaces of a plurality of cylinders in a printing press is provided wherein a plurality of pressing elements are disposed each for selective engagement with the working surface of at least one of the cylinders and a web of cleaning cloth is disposed to move successively over the pressing elements and is selectively urged by the pressing elements into relative rubbing contact with the working surfaces of at least two of the cylinders. A drive for stepwise advancing and arresting the movement of the cleaning cloth with respect to the pressing elements and the working surfaces of the cylinders includes a clean cloth spindle disposed transverse to the stepwise movement for supplying said web of cleaning cloth and a stepwise drivable dirty cloth spindle disposed parallel to the clean cloth spindle and adapted to receive the used cleaning cloth. Preferably spraying nozzles are provided for applying cleaning agents to the back side of the web of cleaning cloth, as well as control means for controlling the selective engagement of the pressing elements and the stepwise advancement of the cleaning cloth. The control means is arranged to selectively control the engagement of the pressing elements either individually or collectively, as desired and the clean web may be presented to the successive cylinders in either wet or dry condition. Optionally, a pressing element may also be employed to urge the cleaning cloth into engagement with the impression cylinder of the printing press.

10 Claims, 4 Drawing Sheets

DEVICE FOR CLEANING THE WORK SURFACES OF A WORK MACHINE, MORE PARTICULARLY IN A PRINTING PRESS

FIELD OF THE INVENTION

The present invention relates generally to devices for cleaning the working surfaces of the cylinders of a printing press and more particularly concerns such a device wherein a plurality of cylinders can be successively cleaned with the same cleaning cloth.

BACKGROUND OF THE INVENTION

In the past, various devices have been employed for cleaning the individual cylinders in printing presses, particularly the blanket cylinders in offset presses. U.S. Pat. No. 2,525,982, for example discloses a web-type cleaner that may be urged against a cylinder by a pad or wick through a mechanical cam or lever actuating arrangement. In German Pat. No. DE-PS 3,005,469 a web-like cleaner is urged against a cylinder by a pressurized chamber.

It is also known from the prior art, such as Swiss Pat. No. CH-PS647,718 that a number of cylinders of a printing press can be consecutively cleaned with separate washing devices which can be joined to form an overall cleaning unit. A somewhat different approach is disclosed in German Pat. No. DE-PS 11 79 223 wherein a printing press cylinder is "dry cleaned" with an electrically charged web which may itself be solvent cleaned, dried, brushed or otherwise charged before being brought back into contact with the cylinder. This reference also disclosed such an arrangement for cleaning both a blanket cylinder and an inking roller for feeding ink to a plate cylinder.

OBJECTS AND SUMMARY OF THE INVENTION

It is the primary aim of the present invention to provide a cleaning device for the working cylinders of a printing press wherein a plurality of the cylinders may be selectively cleaned and/or dried with the use of a single web of cleaning cloth that advances successively into selective engagement with the appropriate cylinders.

It is a more detailed object to provide such a device wherein the cleaning cloth is advanced in stepwise fashion such that a clean portion of the cloth is always presented to the successively cleaned cylinders and wherein controls are provided to permit the clean segments of the cleaning cloth to be presented selectively in either wet or dry condition to the respective working surfaces of the press cylinders as may be desired by the operator.

To accomplish the foregoing objects according to the present invention, a device for cleaning the working surfaces of a plurality of cylinders in a printing press is provided wherein a plurality of pressing elements are disposed each for selective engagement with the working surface, of at least one of the cylinders and a web of cleaning cloth is disposed to move successively over the pressing elements and is selectively urged by the pressing elements into relative rubbing contact with the working surfaces of at least two of the cylinders. A drive for stepwise advancing and arresting the movement of the cleaning cloth with respect to the pressing elements and the working surfaces of at least two of the cylinders includes a clean cloth spindle disposed transverse to the stepwise movement for supplying said web of cleaning cloth and a stepwise drivable dirty cloth spindle disposed parallel to the clean cloth spindle and adapted to receive the used cleaning cloth. Preferably spraying nozzles are provided for applying cleaning agents to the back side of the web of cleaning cloth, as well as control means for controlling the selective engagement of the pressing elements and the stepwise advancement of the cleaning cloth. The control means is arranged to selectively control the engagement of the pressing elements either individually or collectively, as desired and the clean web may be presented to the successive cylinders in either wet or dry condition. Optionally, a pressing element may also be employed to urge the cleaning cloth into engagement with the impression cylinder of the printing press.

These and other features and advantages of the invention will be more readily apparent upon reading the following description of a preferred exemplified embodiment of the invention and upon reference to the accompanying drawings wherein:

While the invention will be described and disclosed in connection with certain preferred embodiments and procedures, it is not intended to limit the invention to those specific embodiments. Rather it is intended to cover all such alternative embodiments and modifications as fall within the spirit and scope of the invention.

DETAILED DESCRIPTION OF THE PREFERRED EMBODIMENTS

Figure 1:
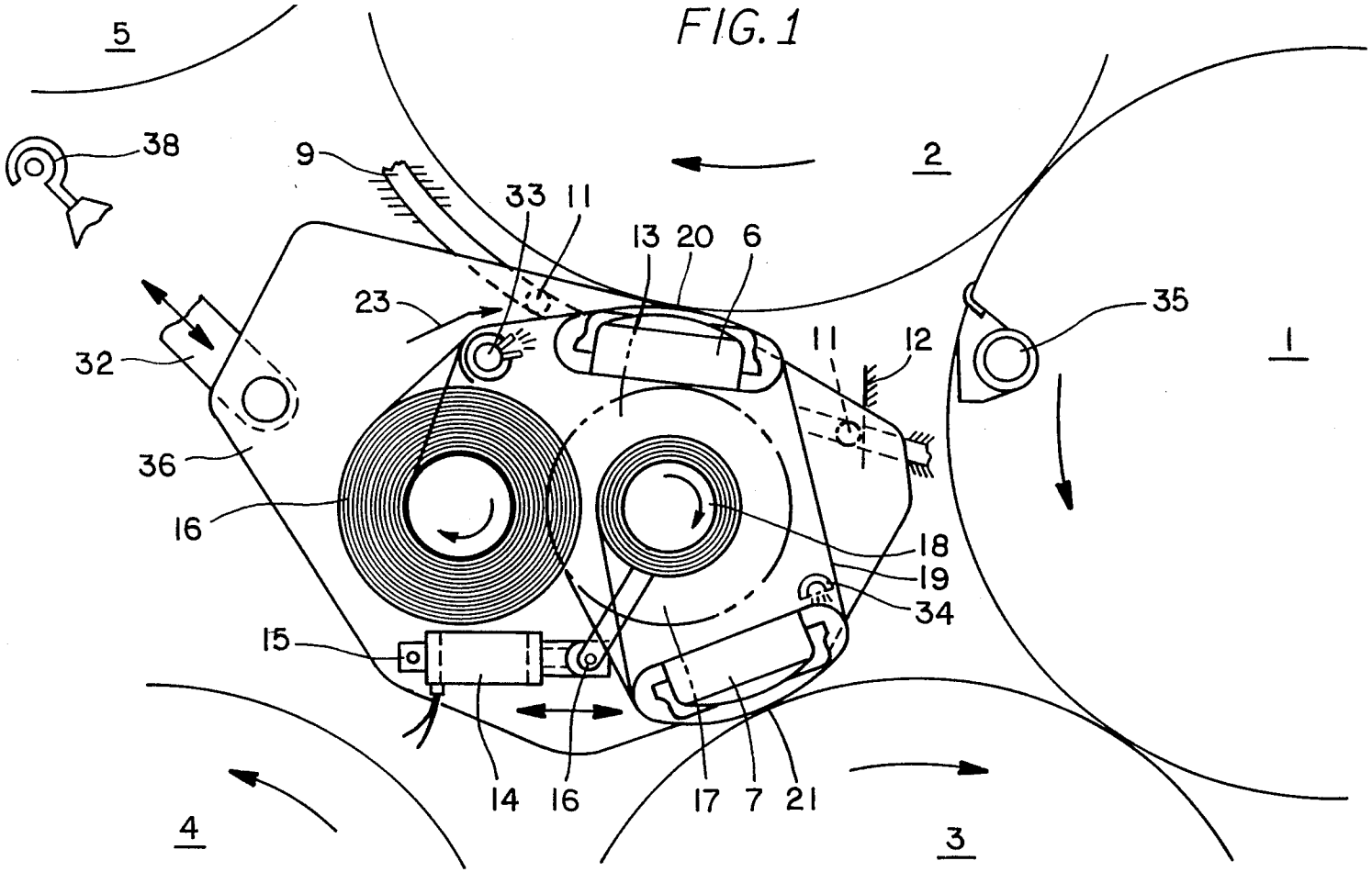
FIG. 1 is a diagrammatic view of an embodiment of the device according to the invention for a five-cylinder printing press.

Turning now to FIG. 1 of the drawings, the five working cylinders 1–5 of a duplex-type printing press are illustrated in schematic form. Basically, an impression cylinder 1 rotates counterclockwise and engages two blanket cylinders 2 and 3 which, as shown in FIG. 1, define an open space therebetween. One of a pair of plate cylinders 4 and 5 cooperate, respectively with the blanket cylinders 2, 3 in conventional fashion. It will be understood that the working cylinders 1–5 each have an axis disposed generally horizontally and parallel to one another and the cylinders are journalled at their respective ends in the side uprights of the printing press (not shown). Likewise, the means for driving the cylinders 1–5 in timed relation to one another may be conventional and therefore is not specifically disclosed herein.

In accordance with the present invention, a plurality of pressing elements 6 and 7 and a web of cleaning cloth 19 are disposed for selective engagement with a plurality of the working cylinders 1–5, more specifically blanket cylinders 2 and 3 in FIG. 1, for successively cleaning the working surfaces of the cylinders 2 and 3 as required. In the illustrated embodiment, the pressing elements 6 and 7 are secured to and carried by a pair of side frames 36 (only one of which is shown) movably supported by rollers 11 or the like in guide slots 19 or rails formed in the press uprights or subframe elements (not shown). Preferably, an adjustable stop 12 is provided to limit the movement of the side frames 36 and the pressing element into the operative position with respect to the working cylinders 2 and 3. Also, after a cleaning operation, the device can be moved away from the cylinders 2, 3 along the guide slots 9 and pivoted into a parked position by means of parking bracket such as a hook and pin arrangement 38 on the press frame. This feature ensures ready access to, and an unobstructed view of, the bottom cylinder group 3, 4 of the printing cylinder group 1–5 for other servicing, inspection and run-on. The cleaning device is further provided with a selective drive linkage 32 coupled to one of the side frames 36 for moving the pressing elements 6 and 7 into and out of the space between the cylinders 2 and 3.

Pursuant to a further aspect of the invention and as mentioned above, a single web of cleaning cloth 19 is provided for cooperating with the pressing elements 6 and 7 for selective engagement and relative rubbing contact with the working surfaces of the cylinders 2 and 3. To supply clean portions of the cleaning cloth 19 to the respective pressing elements 6, 7 and blanket cylinders 2, 3, a clean cloth spindle 10 and, parallel thereto, a dirty cloth spindle 13 are provided in known manner, with the cleaning cloth 19 initially being rolled up on the spindle 10. Thus, it will be understood, the cleaning cloth 19 is unwound from the spindle 10, stretched over stabilizing cross-members (not shown in further detail) and guided before spraying means 33, 34 disposed in advance of the pressing elements 6 and 7. The rows of nozzles 33, 34 spray washing agents and water uniformly on to the back of the cleaning cloth 19. The now moist cloth is conveyed stepwise over the pressing elements 6, 7 which press it gently on to the rotating cylinders 2, 3. Also in accordance with the invention and as described in more detail hereafter, during the cleaning operation, the cloth 19 advances stepwise and it is possible to select how many steps with spraying are used for washing and how often the unmoistened cloth should be pressed on to the cylinders 2, 3 for drying. The dirty cloth 19 is wound on to the dirty cloth spindle 13 after passing over a second stabilizing cross-member (not shown).

In the preferred embodiment, support arms (not shown) are provided between the side frames 36 and extend substantially between the blanket cylinders 2, 3, the cleaning cloth spindle 10 and the dirty cloth spindle 13. Desirably, the pressing elements 6, 7 have U-section bars sheathed in a resilient skin made, for example, of a rubbery material and the elements 6, 7 extend along the cylinders 2, 3 and between the side frames 36. They are connected in an appropriate manner to a compressed air supply (not shown) connected to a corresponding line. When the pressing elements 6, 7 are pressurized, the bottom of the skin moves from its normal position into its operative position to press the cloth 19 into engagement with the surface of the corresponding cylinder 2, 3, when the cylinders 2, 3 are being cleaned.

Pursuant to another aspect of the invention, means ar provided to advance the cleaning cloth 19 stepwise and convey the cloth 19 irrespective of the quantity thereof present on the clean cloth spindle 10 or dirty cloth spindle 13. In the instant embodiment, the means comprise a pneumatic actuating cylinder 14 rotatably mounted in a pivot 15 on the side frame 36. The cylinder 14 is air-operated by way of a pressure line (not shown) and a spring within the cylinder biases the cylinder 14 into its normal position. The cylinder 14 includes a piston rod which terminates in a fork 16 connected by way of a pivot to one arm of a crank drive 17. The crank drive has a free wheel clutch 18 which drives the dirty cloth spindle 13 in just one direction, viz. clockwise in FIG. 1. Rotation in the opposite direction is prevented by a second freewheel clutch (not shown) at the other end of the spindle 13. When the piston of the actuator 14 is moved by air pressure, the clutches 18 are effective as feeding means—i.e., as stepping element. The inner member of the clutch 18 drives an outer race operatively. When the air pressure ceases the clutch 18 releases and therefore acts as a freewheel so that the piston of the actuator 14 returns to its initial position. The actuator 14 therefore produces a stepwise advance of the cleaning cloth 19. The same is advanced stepwise substantially by a constant amount irrespective of the amount of cloth 19 present on the clean cloth spindle 10.

By way of illustration, a cleaning cloth 19 approximately 10 meters long is generally sufficient for approximately 100 washing operations if the average working step is approximately 10 cm. It will be understood that the details of the system for spraying on the liquid, details of the air control and details of the electrical control of the device may be of conventional design and are not shown.

Figure 2:
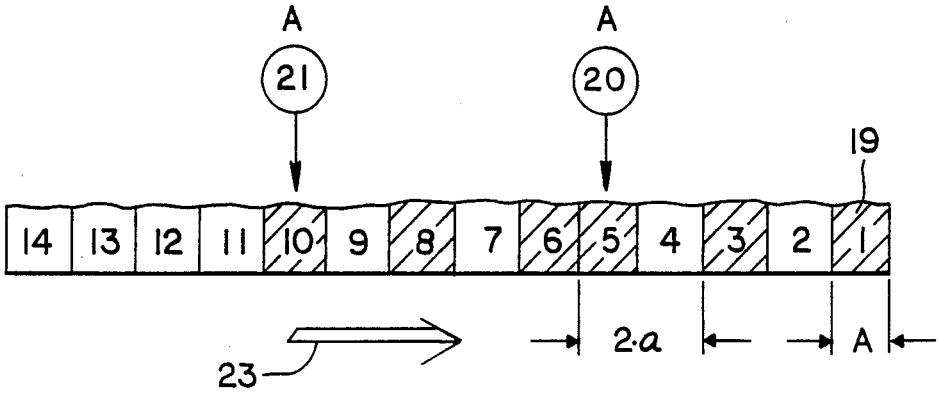
FIG. 2 is a diagrammatic view showing the principle of feeding the cleaning strip or web in equal steps whose size is twice that of the working area A.

In contrast to the prior art, in the embodiment shown in FIG. 1 the stepwise movement of the cloth 19 is twice the working areas A, 20, 21 of the cylinders 2, 3 and odd-numbered steps a1, a3, a5 and so on of the cleaning cloth 19 are associated with that working surface A, 20 of the blanket cylinder 2 which is first as considered in the direction 23 of movement, even-numbered steps a2, a4, a6 and so on of the cloth 19 being associated with the next working area A, 21 of the blanket cylinder 3 (see FIGS. 1 and 2). Consequently, no soiled cleaning cloth 19 moves over the next cylinder 2.

As an alternative to a staggered advance of this kind with twice the step size, a simple control of step size makes it possible to intervene in the electrical control of the device in order to achieve a predetermined programming for the preparation of a greater length of clean cloth and then to facilitate a number of consecutive washing operations. The basic electrical control is described in detail in the above-mentioned Pat. No. DE-PS 3 005 469.

Figure 3:
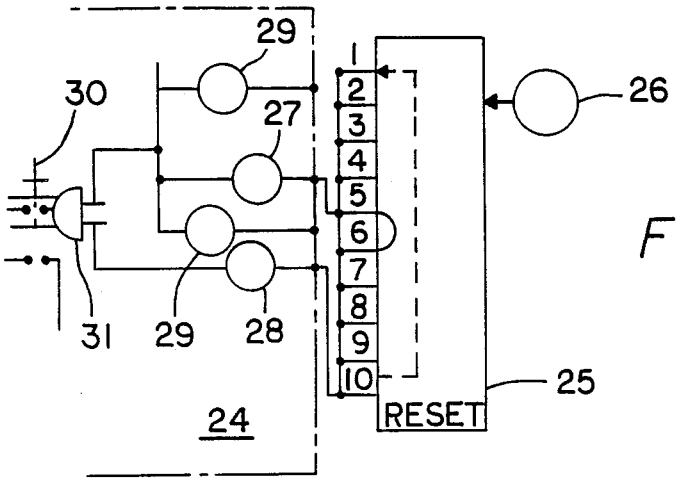
FIG. 3 shows a supplementary circuit arrangement for the control means of the device.

In the embodiment shown in FIG. 3 an additional circuit arrangement 25–31 can be integrated into the electrical control facility 24 of the device to enable the rotating drive of the cloth 19 to be triggered consecutively a number of times with the same steps without triggering a washing operation, in order to provide a supply of clean cloth 19 in line with the distance between the cylinders 2 and 3, before the cloth 19 can be moved in accordance with the instruction of a ring counter 25 with the triggering of washing operations in the same single-size cleaning steps until the prepared cleaning cloth has been consumed.

The ringer counter 25 is a counting register for counting make pulses 26 and for storing the counting result. The counter 25 comprises a number of bistable multivibrators which are connected in series in a chain and whose total state after each pulse corresponds to the number reached. Referring to FIG. 3, for example, five first input pulses 26 of the ring counter 25 can be transmitted to a time function element 27 and the switch 30 for the solenoid valve (not shown) for actuating the actuator 14 can be activated by way of an or-gate. During the trigger of the first five make pulses 26 the spraying means and other events necessary for cleaning are also actuated over a first channel by way of the time function elements 29. During the triggering of the second five input pulses 26 of the ring counter are triggered, the switch 30 of the solenoid valve (not shown) can be activated by way of a second time function element 28 over a second channel without washing operations also being triggered.

Consequently, a preprogrammed stepping sequence first prepares sufficient clean cleaning cloth for a cycle of, for example, five washing operations, whereafter a cleaning operation is facilitated in five single-size steps in which no soiled cleaning cloth 19 can at any time move over the immediately following cylinders 2 and/or 3.

According to another embodiment of the invention, mechanical pressing elements can be provided instead of the internally pressurized pressing elements. The principle of mechanical actuation of their movement by cam control in order to move mechanical pressing elements into and out of engagement with the working surfaces 20–22 of the cylinders 1–3, the latter surfaces moving relatively to the cleaning cloth 19, is known from U.S. Pat. No. 2,525,982 and will not be further described herein.

Figure 4:
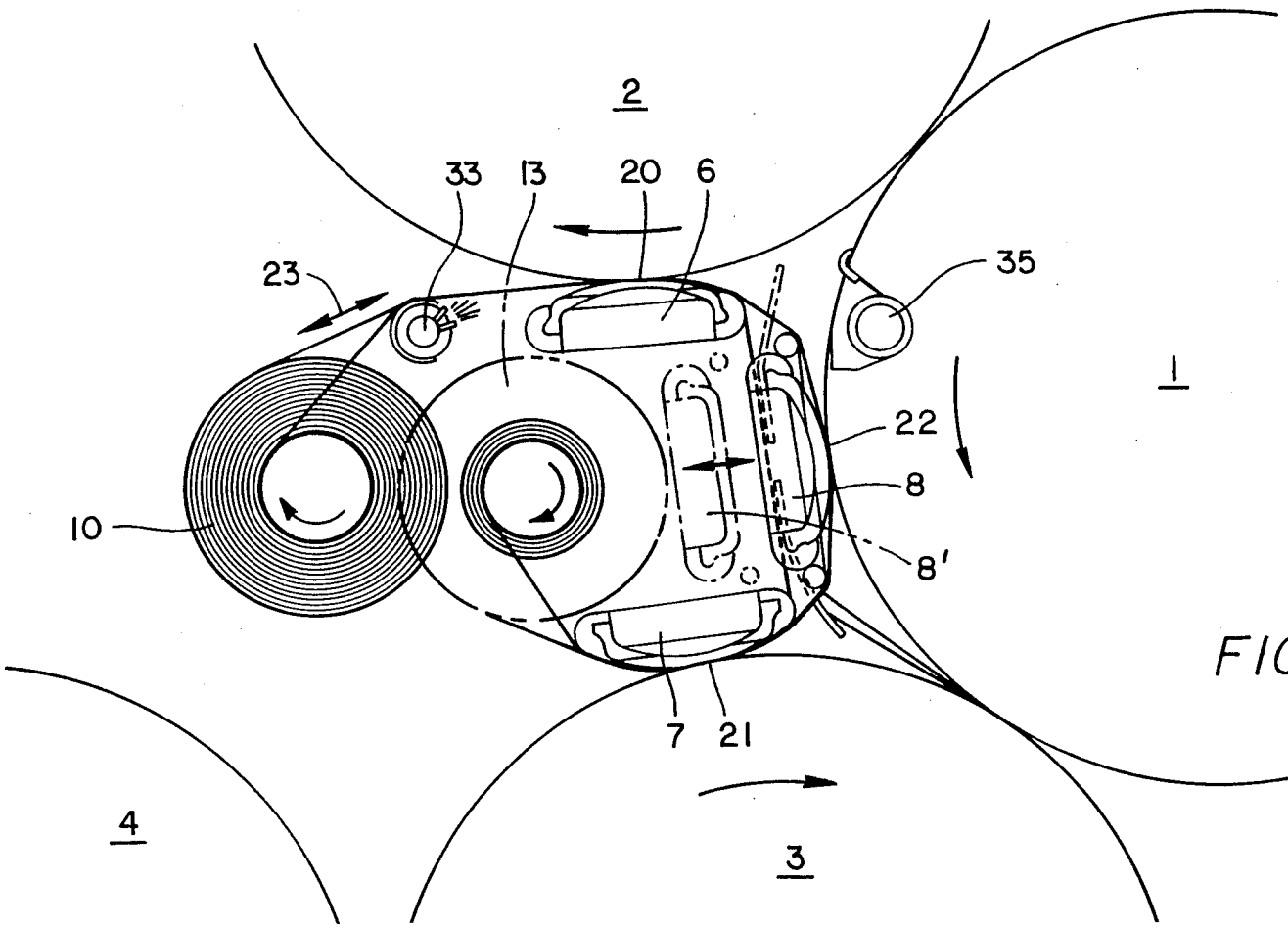
FIG. 4 shows an embodiment comprising a third pressing element which is associated with the impression cylinder.

Referring now to FIG. 4, one pressing element 6–8 each is associated with one cylinder 1–3 each so that the two blanket cylinders 2, 3 can be washed consecutively but the impression cylinder 1 can also be washed. Since a sheet-guiding problem exists in this case and the freshly printed sheet must be prevented from setting off on the pressing element 8, the same must be moved from the solid-line position 8 into the dash-line position 8' away from the impression cylinder 1 and returned to the operative position only during the washing operation. Means for this purpose are widely known and are not illustrated.

Figure 5:
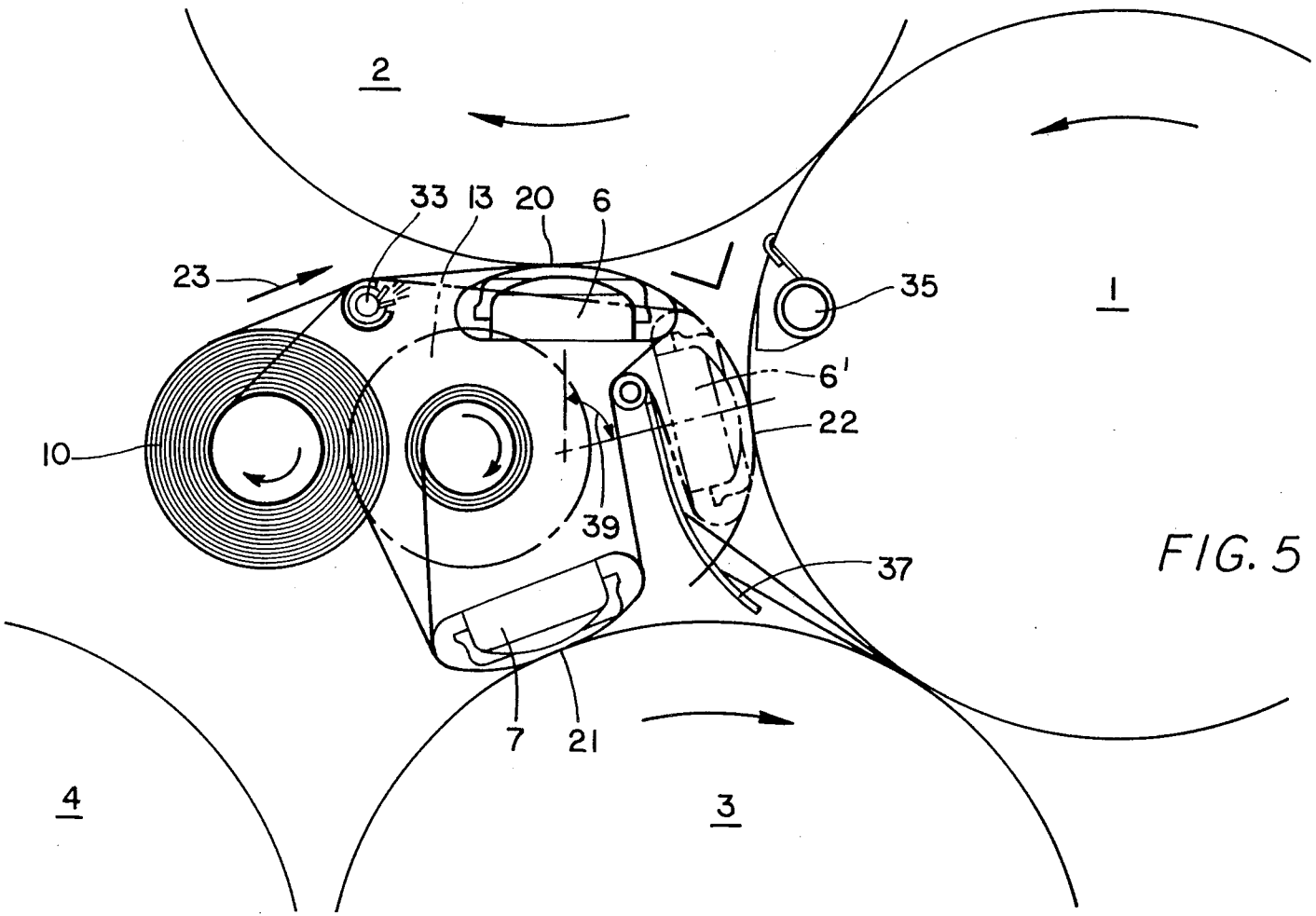
FIG. 5 shows an embodiment in which the pressing element can be pivoted from the top blanket cylinder to the impression cylinder.

In an alternative embodiment shown in FIG. 5, the pressing element 6 can be pivoted away from the blanket cylinder 2 and on to the impression cylinder 1. This is indicated by the arrow 39 in FIG. 5. The cleaning cloth 19 is initially kept away from the impression cylinder 1 by a removable sheet-guiding plate 37. During the washing operation the pressing element 6' (shown in dash-lines) must be so controlled that the impression cylinder grippers 35 can be moved readily. After the washing of the impression cylinder 1 the pressing element 6' pivots back into its original solid-line position towards the top blanket cylinder 2.

We claim as our invention:

1. In a rotary offset printing press having a main frame, a device for cleaning the working surfaces of a plurality of cylinders including an impression cylinder engageable by first and second blanket cylinders which define an open space therebetween, comprising in combination, a plurality of pressing elements including first and second pressing elements respectively disposed in said open space for selective engagement with the working surfaces of said first and second blanket cylinders, a web of cleaning cloth having a back side and a front side with the back side disposed to move successively over said pressing elements and the front side disposed to be selectively urged by said pressing elements into relative rubbing engagement with the working surfaces of said blanket cylinders, means for stepwise advancing and arresting the movement of said cleaning cloth with respect to said pressing elements and the working surfaces of said blanket cylinders, supply means including a clean cloth spindle disposed transverse to said stepwise movement for supplying said web of cleaning cloth, a stepwise drivable dirty cloth spindle disposed parallel to said clean cloth spindle and adapted to receive the supplied cleaning cloth thereon, side frame means for supporting said pressing elements and said cleaning cloth advancing and arresting means, roller means for supporting and guiding said side frame means for movement of said device relative to said main frame and said cylinders, drive linkage means for moving said device on said roller means between a pushed-in operative position in said open space between said blanket cylinders and a pushed-out parking position away from said cylinders, means between said side frame means for applying cleaning agents to said web of cleaning cloth, control means for controlling the selective engagement of said pressing elements and the stepwise advancement of said cleaning cloth, said control means being arranged to selectively control the engagement of said pressing elements with the back side of said cleaning cloth and to selectively urge the front side of said cleaning cloth into relative rubbing engagement with the working surfaces of said cylinders when said device is moved by said drive linkage means to said pushed-in operative position.

2. A device according to claim 1, including an adjustable stop and a parking bracket mounted on said main frame, said adjustable stop being disposed to limit the extent of movement of said device by said drive linkage toward said pushed-in or operative position and said parking bracket being disposed to secure said device to said main frame when said device is moved to said pushed-out position or parking position.

3. A device according to claim 1, characterized in that a third pressing element is selectively engageable with said impression cylinder of the printing press and is located between said first and second pressing elements with respect to the direction of movement of said cleaning cloth.

4. A device according to claim 1, characterized in that said first pressing element is selectively movable out of engagement with said first blanket cylinder and into engagement with said impression cylinder which is disposed in engagement with said first and second blanket cylinders.

5. In a rotary offset printing press having a main frame, a device for cleaning the working surfaces of a plurality of cylinders including an impression cylinder engageable by first and second blanket cylinders which define an open space therebetween, comprising in combination, a plurality of pressing elements including first and second pressing elements respectively disposed in said open space for selective engagement with the working surfaces of said first and second blanket cylinders, a web of cleaning cloth having a back side and a front side with the back side disposed to move successively over said pressing elements and the front side disposed to be selectively urged by said pressing elements into relative rubbing engagement with the working surfaces of said blanket cylinders, means for stepwise advancing and arresting the movement of said cleaning cloth with respect to said pressing elements and the working surfaces of said blanket cylinders, supply means including a clean cloth spindle disposed transverse to said stepwise movement for supplying said web of cleaning cloth, a stepwise drivable dirty cloth spindle disposed parallel to said clean cloth spindle and adapted to receive the supplied cleaning cloth thereon, side frame means for supporting said pressing elements and said cleaning cloth advancing and arresting means, means between said side frame means for applying cleaning agents to said web of cleaning cloth, control means for controlling the selective engagement of said pressing elements and the stepwise advancement of said cleaning cloth, said control means being arranged to selectively control the engagement of said pressing elements with the back side of said cleaning cloth and to selectively urge the front side of said cleaning cloth into relative rubbing engagement with the working surfaces of said cylinders, and control means being arranged to selectively control said stepwise advancing means for advancing said cleaning cloth a distance that is equal to twice the step length dimension of the area of engagement of said cleaning cloth with each of said blanket cylinders, with an odd number of steps being associated with the engagement area of said first blanket cylinder while the even-numbered steps are associated with the next engagement area of said second blanket cylinder.

6. A device according to claim 5, characterized in that a third pressing element is selectively engageable with said impression cylinder of the printing press and is located between said first and second pressing elements with respect to the direction of movement of said cleaning cloth.

7. A device according to claim 5, characterized in that said first pressing element is selectively movable out of engagement with said first blanket cylinder and into engagement with said impression cylinder which is disposed in engagement with said first and second blanket cylinders.

8. In a rotary offset printing press having a main frame, a device for cleaning the working surfaces of a plurality of cylinders including an impression cylinder engageable by first and second blanket cylinders which define an open space therebetween comprising in combination, a plurality of pressing elements including first and second pressing elements respectively disposed in said open space for selective engagement with the working surfaces of said first and second blanket cylinders, a web of cleaning cloth having a back side and a front side with the back side disposed to move successively over said pressing elements and the front side disposed to be selectively urged by said pressing elements into relative rubbing engagement with the working surfaces of said blanket cylinders, means for stepwise advancing and arresting the movement of said cleaning cloth with respect to said pressing elements and the working surfaces of said blanket cylinders, supply means including a clean cloth spindle disposed transverse to said stepwise movement for supplying said web of cleaning cloth, a stepwise drivable dirty cloth spindle disposed parallel to said clean cloth spindle and adapted to receive the supplied cleaning cloth thereon, side frame means for supporting said pressing elements and said cleaning cloth advancing and arresting means, means between said side frame means for applying cleaning agents to said web of cleaning cloth, control means for controlling the selective engagement of said pressing elements and the stepwise advancement of said cleaning cloth, said control means being arranged to selectively control the engagement of said pressing elements with the back side of said cleaning cloth and to selectively urge the front side of said cleaning cloth into relative rubbing engagement with the working surfaces of said cylinders, and said control means including an electric circuit arrangement and a counter enabling said stepwise advancing means to be activated to advance a supply of cleaning cloth without triggering said means for applying cleaning agents to said cleaning cloth a number of times consecutively, then to be activated with triggering of said cleaning agent applying means with the same step size, corresponding to the size of the area of engagement of said cleaning cloth with the working surfaces of said cylinders.

9. A device according to claim 8, characterized in that a third pressing element is selectively engageable with said impression cylinder of the printing press and is located between said first and second pressing elements with respect to the direction of movement of said cleaning cloth.

10. A device according to claim 8, characterized in that said first pressing element is selectively movable out of engagement with said first blanket cylinder and into engagement with said impression cylinder which is disposed in engagement with said first and second blanket cylinders.

* * * * *